US008348237B2

(12) United States Patent
Shi

(10) Patent No.: US 8,348,237 B2
(45) Date of Patent: Jan. 8, 2013

(54) ONE KIND OF FOOT PEDAL HYDRAULIC JACK WITH TWO SPEED PUMP, AND THERE IS A PNEUMATIC SET TO LIFT PISTON QUICKLY ON THE JACK

(75) Inventor: Zhigiang Shi, Jiangsu (CN)

(73) Assignee: Changshu Tongrun Auto Accessory Co., Ltd., Changshu, Jiangsu (CN)

( * ) Notice: Subject to any disclaimer, the term of this patent is extended or adjusted under 35 U.S.C. 154(b) by 1087 days.

(21) Appl. No.: 12/272,426

(22) Filed: Nov. 17, 2008

(65) Prior Publication Data

US 2009/0134375 A1 May 28, 2009

(30) Foreign Application Priority Data

Nov. 26, 2007 (CN) ..... 2007 2 0042311 U

(51) Int. Cl.
*B66F 3/24* (2006.01)
*B66F 3/42* (2006.01)
*F15B 15/02* (2006.01)

(52) U.S. Cl. ..... 254/93 R; 254/93 H; 60/478; 91/457

(58) Field of Classification Search ..... 254/93 H, 254/93 R, 2 R; 60/478
See application file for complete search history.

(56) References Cited

U.S. PATENT DOCUMENTS 2,091,729 A * 8/1937 Countryman ..... 60/459
2,284,958 A * 6/1942 Grime ..... 254/1
2,352,390 A * 6/1944 Kirkland ..... 60/475
2,828,611 A * 4/1958 Johansson et al. ..... 60/481
2,837,222 A * 6/1958 Trautman et al. ..... 414/589
5,000,424 A * 3/1991 Inoue ..... 254/93 H
5,620,027 A * 4/1997 Sato ..... 137/625.66
5,975,496 A * 11/1999 Hong et al. ..... 254/2 R
6,027,101 A * 2/2000 Marx ..... 254/93 H
6,378,843 B1 * 4/2002 Hong ..... 254/2 R
6,712,092 B2 * 3/2004 Toliusis ..... 137/625.27
7,171,807 B2 * 2/2007 Fox et al. ..... 60/478
7,694,940 B2 * 4/2010 Yueh ..... 254/93 H
2006/0225415 A1 * 10/2006 Obayashi et al. ..... 60/477
2008/0048159 A1 * 2/2008 Dai et al. ..... 254/93 H

* cited by examiner

*Primary Examiner* — Lee D Wilson
*Assistant Examiner* — Marc Carlson
(74) *Attorney, Agent, or Firm* — Ladas & Parry, LLP

(57) ABSTRACT

In pneumatic non-load quick dual-speed hydraulic jack, the small of piston ring (17) of hydraulic pump cylinder integrates with pump body (19) and external ring of step pump core (14) to form movable assembly. The middle part of step pump core (14) is provided with pump core step interface (8) used for conversion of hydraulic speed. The step hole on the same axis of pneumatic valve block on special pneumatic valve structure is provided with washer (48), button (49), pneumatic valve core (45), compressed spring (68) and valve core fastness set. The pneumatic valve parts can replace the hydraulic quick pump structure partially when the high-pressure air source is available. High-pressure air delivered to the oil reservoir of the external sleeve (4) presses the hydraulic oil into the oil chamber of oil cylinder, and thus facilitates the quick lift of jack piston under light load or empty load.

10 Claims, 6 Drawing Sheets

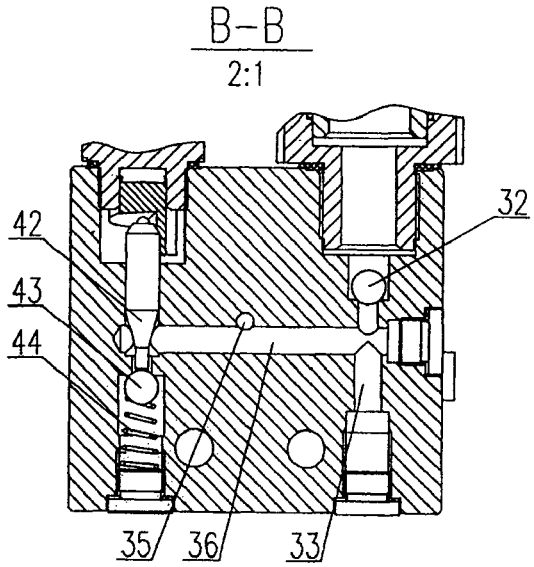
FIG. 5
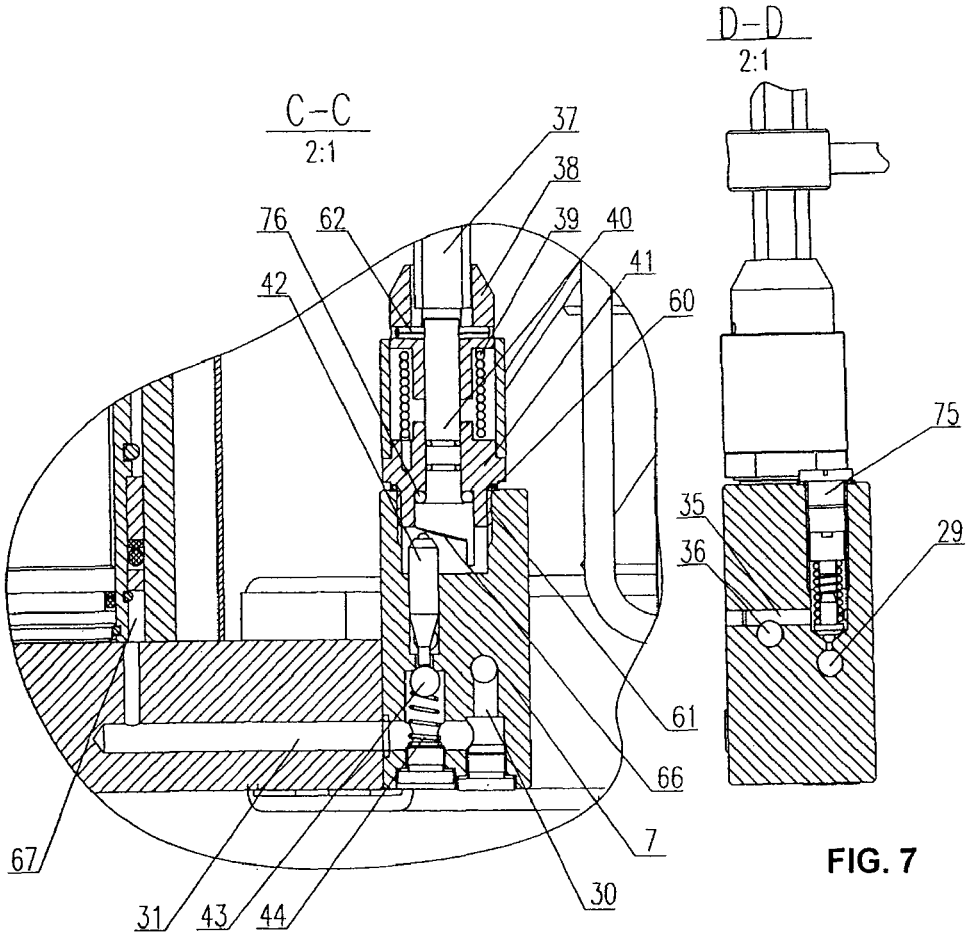
FIG. 7
FIG. 6

ONE KIND OF FOOT PEDAL HYDRAULIC JACK WITH TWO SPEED PUMP, AND THERE IS A PNEUMATIC SET TO LIFT PISTON QUICKLY ON THE JACK

FIELD OF THE INVENTION

This invention involves a type of hoisting tool, especially a type of pneumatic non-load quick dual-speed hydraulic jack.

BACKGROUND OF THE INVENTION

Hydraulic jack is a type of hoisting equipment widely applied to lift of vehicles or heavy goods. Existing hydraulic jack normally adopts the dynamic oil cylinder using single-post pump core and pump body hole to realize the clearance fit, which is characterized by simple structure and low technical cost. However, it is far from being able to satisfy the functional requirement for quick ascending as required by the hydraulic jack under zero or light load. As disclosed by Chinese patent ZL200620075069.1, the dual-speed vertical hydraulic jack, oil sucked by the pump core of hydraulic system of zero load or light load under low pressure can be fully pressed into the working oil chamber; whereas, partial oil is pressed into the upper chamber of the pump cylinder when the system is under high pressure. Partial oil pressed into the chamber of working oil cylinder can drive the piston assembly to hoist the loaded goods stably and quickly under the action of oil of minimal flux. As the structural technique of the pump core and pump body is so complicated, the high fabrication cost would affect the competition power of the product in international market.

SUMMARY OF THE INVENTION

In consideration of the deficiencies of aforesaid comparative technical proposal, this invention aims to put forward a type of dynamic pump of manual operation for hydraulic jack for the purpose of realizing the function of quick pump under low pressure and slow pump under high pressure for hydraulic jack in the form of relatively simple composite pump core. Meanwhile, it is also expected to provide an optional proposal for non-load pneumatic structure: make use of the high-pressure air as the driving force to press the high-pressure air into the oil chamber of the jack, so as to make the chamber of piston cylinder of the jack absorb the hydraulic oil of high flux pressed out from the oil chamber under relatively high pressure, and thus realize the quick lift of piston rod under zero or light load.

Aforesaid purposes of this invention are realized through the following technical proposal: A type of pneumatic non-load quick hydraulic dual-speed jack, including framework, base, piston rod, oil cylinder, external sleeve, connecting rod, pin, pedal rod, pump core, pump body, seal and oil return valve, has the following features: valve soleplate is fixed to the base; the lower fastness set on the pump body is sealed and fixed to the valve soleplate; the pump body is sealed and fixed to the upper fastness set and lower fastness set respectively; small piston ring on the pump cylinder is integrated with inner hole on the pump body and lower external ring of the step pump core to form movable assembly; the upper end of the fastness set and big external ring of upper fastness set aim to position the compressed spring in accommodation with spring seat; the circlip is used to position the compressed spring; the middle part of step pump core is provided with pump core step interface; a type of pneumatic non-load quick hydraulic dual-speed jack, including pneumatic valve bridge, pneumatic valve block and air source tie-in assembly, has the following features: washer, button, pneumatic valve core, compressed spring and valve core fastness set are provided inside the step hole of pneumatic valve block on the same axis.

As compared with existing technologies, this invention has the following favorable effects: axial hole of small piston ring of the pump cylinder forms a movable pair with step pump core post section through clearance fit; whereas, the external circle of the small piston ring of the pump cylinder forms a movable pair with pump body hole. Owing to the simple structural design, the pump core step interface used for conversion between quick and slow pump has high reliability, which is characterized by the excellent fabricating technique and low cost. Furthermore, the high-pressure air provided for the pneumatic valve parts of this type of jack can quickly press the hydraulic oil into the chamber of working oil cylinder to realize the quick lift of piston cylinder or rod of the jack under zero or light load, and thus improve the practicability of the product, and enhance its competitive power in the market.

BRIEF DESCRIPTION OF THE DRAWINGS

Illumination of attached drawings for empirical examples:

FIG. 5: "B-B" cutaway view of this invention as shown in FIG. 3

FIG. 6: "C-C" cutaway view of this invention as shown in FIG. 3

FIG. 7: "D-D" cutaway view of this invention as shown in FIG. 3

Figure 1:
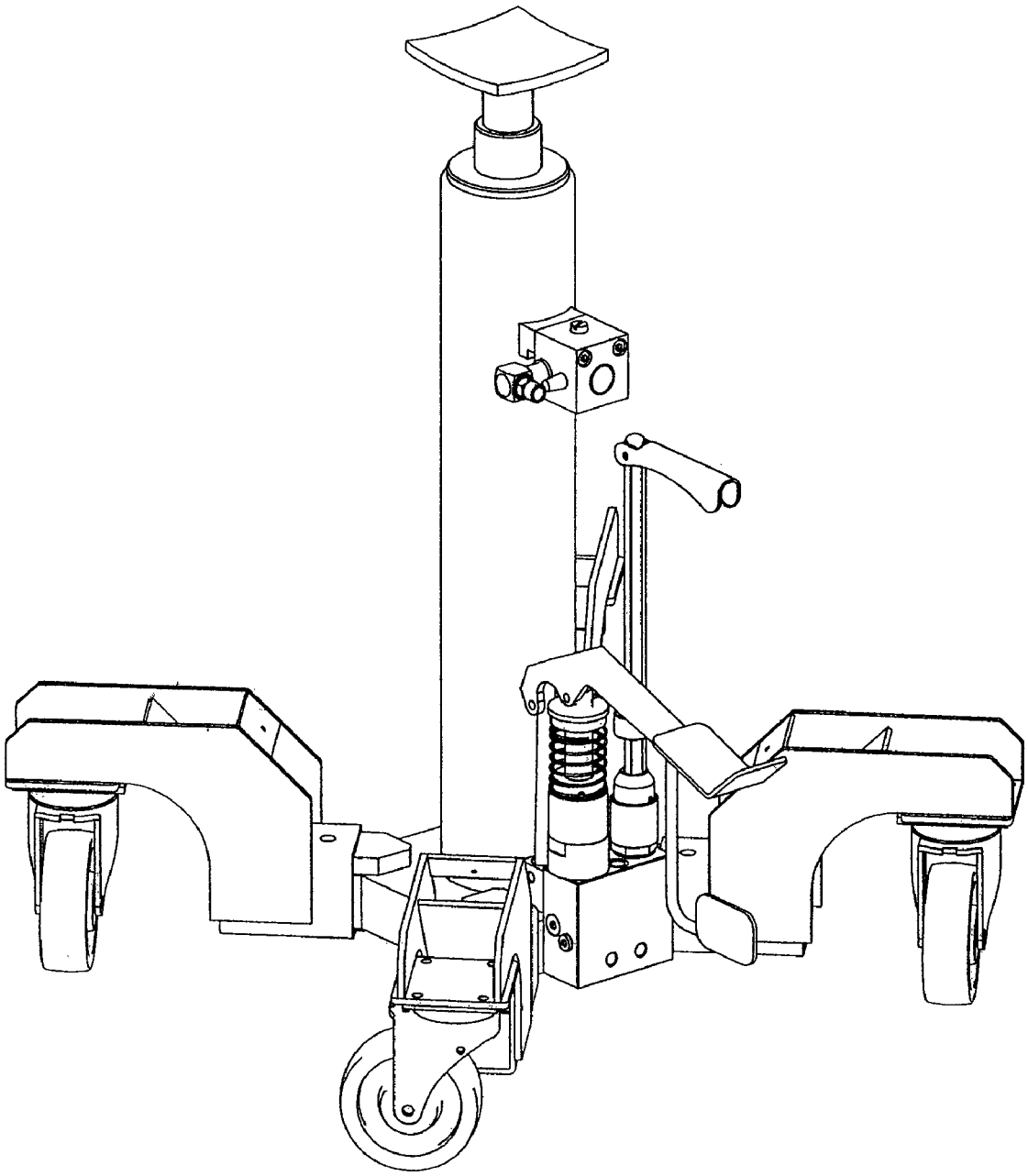
FIG. 1: solid diagram for appearance of this invention
Figure 2:
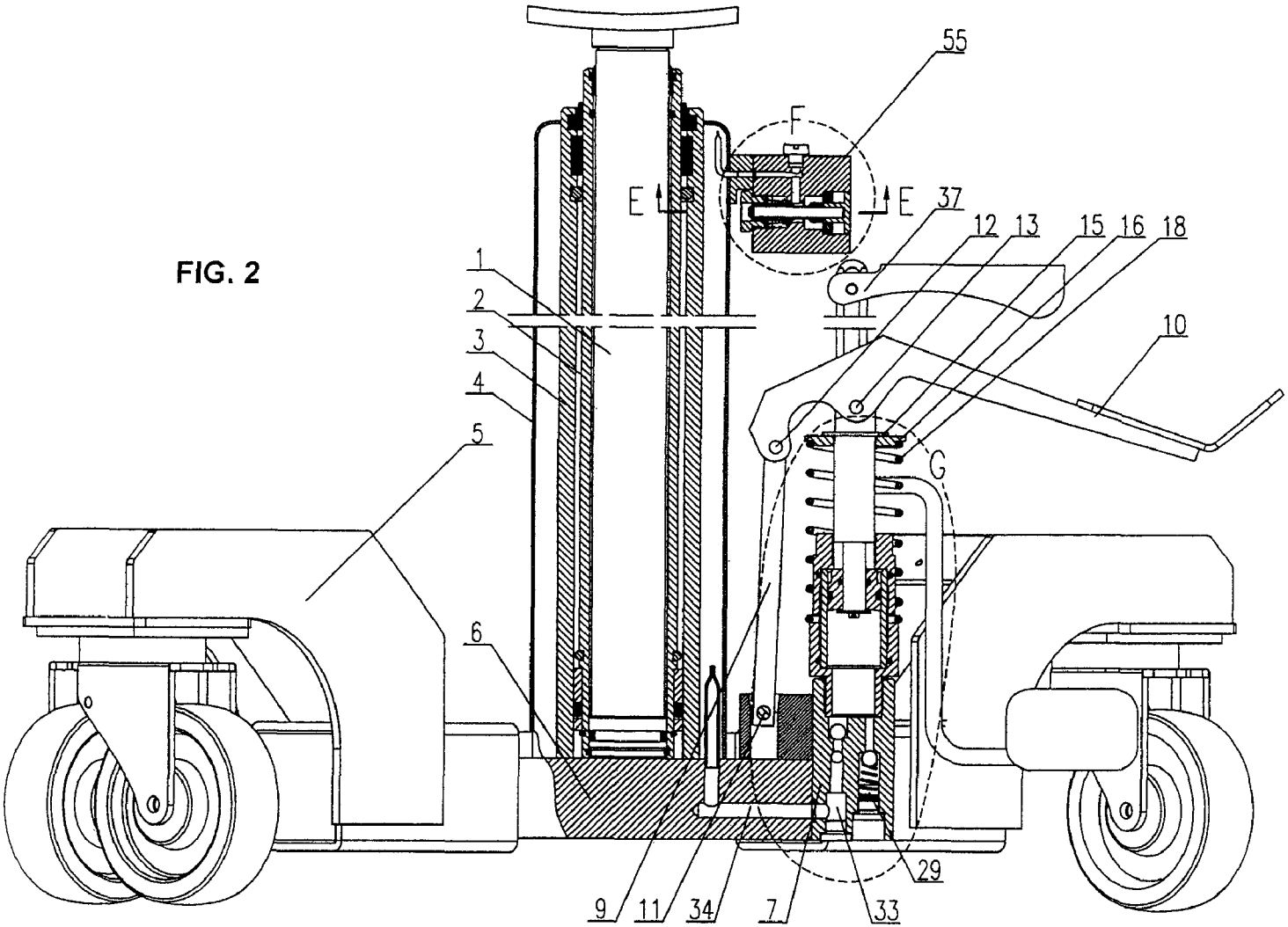
FIG. 2: general view of local sections of this invention
Figure 3:
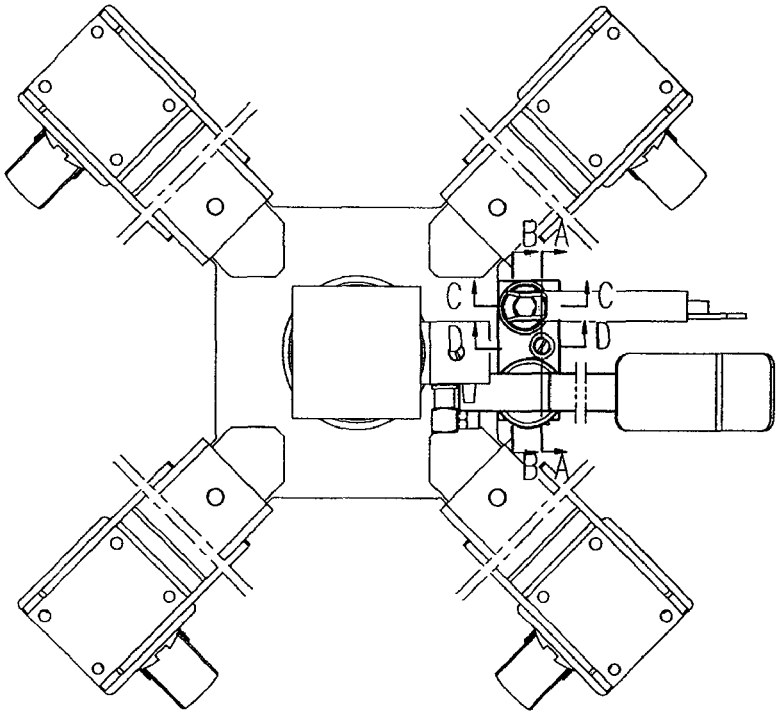
FIG. 3: Planform of this invention
Figure 4:
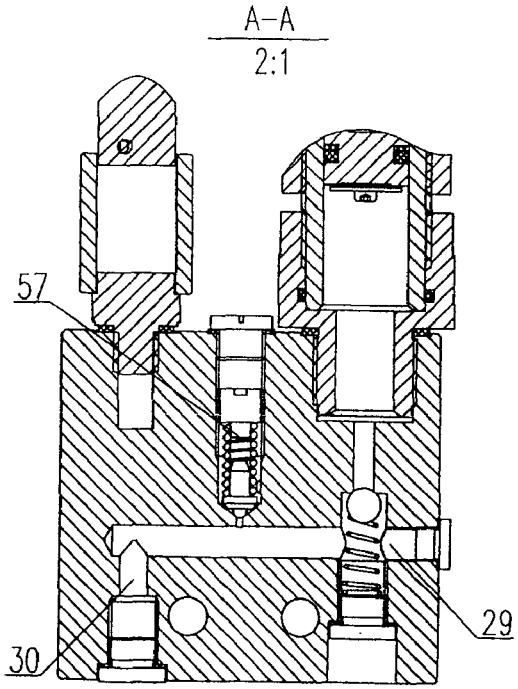
FIG. 4: "A-A" cutaway view of this invention as shown in FIG. 3

Designations of parts as indicated by the tabs on the attached drawings are stated as follows:

1 piston rod, 2. piston cylinder; 3. oil cylinder; 4. external sleeve; 5. framework part; 6. base; 7. valve soleplate; 8. pump core step interface; 9. connecting rod; 10. pedal rod; 11. pin; 12. pin; 13. pin; 14. step pump core; 15. circlip; 16. compressed spring seat; 17. small piston ring on pump cylinder; 18. compressed spring; 19 pump body, 20 upper fastness set, 21 lower fastness set, 22 seal ring, 23 circlip, 24 seal ring, 25 seal ring, 26 pump chamber, 27 inner end surface of step hole, 28 steel ball of oil pressing unilateral valve, 29 oil way, 30 oil way, 31 oil way, 32 steel ball of oil sucking unilateral valve, 33 oil way, 34 oil way, 35 oil way, 36 oil way, 37 oil return joy stick, 38 positioning sleeve of torsion spring, 39 torsion spring, 40 oil return valve rod, 41 fastness set of oil return valve, 42 valve mandril, 43 steel ball of oil return valve, 44 compressed spring, 45 pneumatic valve core, 46 fastness set of valve core, 47 air chamber, 48 washer, 49 button, 50 muffler, 51 seal, 52 seal, 53 high-pressure air chamber, 54 air way, 55 pneumatic valve block, 56 air source tie-in assembly, 57 high-pressure regulating valve assembly, 58 seal, 59 inner cone face, 60 sealing pad, 61 screw pair, 62 elastic column pin, 63 pneumatic valve bridge, 64 pin positioning block of connecting rod, 65 sealing pad, 66 column slanting plane, 67 working oil chamber of oil cylinder, 68 compressed spring, 69 seal, 70 seal, 71 seal, 72 inner hole, 73 seal, 74 hole axial circlip, 75 flat headed screw, 76 ball bearing, 77 seal.

DETAILED DESCRIPTION OF THE INVENTION

Further description of this invention in combination with attached drawings for empirical examples is helpful to the understanding of contents and effect of this technology. However, the empirical example will not impose any limitation on technical proposal of this invention.

As indicated in attached drawing, framework part 5 is firmly fixed to base 6; oil cylinder is welded to base 6; upper and lower parts of external sleeve 4 are sealed and welded to oil cylinder 3 and base 6 respectively; piston rod 1 and piston cylinder 2 form a movable assembly through sealing; piston cylinder 2 and oil cylinder 3 form a movable assembly through sealing; pin positioning block of connecting rod 64 is firmly fixed to the valve soleplate 7; base 6 is firmly fixed to the valve soleplate 7, which subjects to the treatment for hydraulic sealing connection at the junction of corresponding oil way; firmly connect the lower fastness set 21 of pump body to the valve soleplate 7 provided with unilateral valve steel ball 32, oil way 33 and 34 as well as oil pressing unilateral valve steel ball with the help of screw pairs, and provide a sealing pad 65 at the axle of external thread end of the lower fastness set 21 to seal the high-pressure oil between lower fastness set 21 and valve soleplate 7; pump body 19 is connected to the lower fastness set 21 with screw pairs with the seal ring 77 used as the axial static seal between them; the small piston ring 17 on the pump cylinder is installed with the seal ring 22_available for dynamic sealing of hole and axis with step pump core 14; lower end of the step pump core 14 is provided with axial circlip 23; upper fastness set is connected to the upper part of the pump body 19 installed on the small piston ring 17 of the pump cylinder and its fittings with screw pairs, which uses the seal ring 25 as the static seal between the upper external circle of the pump body 19 and upper fastness set 20; clearance fit between the big external circle at the upper part of the step pump core 14 and inner hole of the upper fastness set 20 is not sealed, and the upper end of the lower fastness set 21 as well as the big external circle of upper fastness set 20 are used to position the compressed spring 18 in combination with spring seat 16 and circlip 15; the pin positioning block 64 of connecting rod is equipped with pin 11 to form revolute pair between the lower part of the connecting rod 9 and pin 11; left end of the pedal rod 10 integrates with upper part of connecting rod 9 and pin 12 to form a revolute pair, which makes use of pin 13 to realize revolute connection between the upper part of step pump core 14 and pedal rod 10; the oil pressing oil way 29 is crossly equipped with branch oil way installed with high-pressure regulating valve 57 to limit the loaded oil pressure of the hydraulic system; The upper part of the regulating valve 57 is installed with flat headed screw 75.

As indicated in attached drawing 6, compressed spring 44 is installed under the steel ball 43 of the oil return valve in the discharge oil way of valve soleplate 7; whereas, the upper part of the steel ball 43 is installed with a valve mandril 42 constituting hole and axis moving pair with valve soleplate 7; an inner screw hole is provided at the upper part of the valve mandril 42, which forms screw pair 61 with external screw of oil return valve fastness set; axle face of external screw end of fastness set 41 of oil return valve as well as the sealing pad 60 and upper face of valve soleplate 7 are sealed via tightening screw pair; oil return valve rod 40 and fastness set 41 form a dynamic sealing revolute pair; after the axle and hole fit with a positioning sleeve 38 of torsion spring, the upper part of the valve rod 40 is firmly connected with elastic post pin 62 to facilitate the firm connection between the upper part of valve rod 40 and oil return joy stick; a ball bearing 76 is installed between the inner hole face of the fastness set 41 of oil return valve rod and moving face of valve rod 40; the lower part of the oil return valve rod is provided with a column slanting plane 66 which is in sliding contact with valve mandril 42. Furthermore, a torsion spring 39 is installed between the positioning sleeve 38 of torsion spring and fastness set 41 of oil return valve; both ends of the torsion spring 39 are firmly fixed to the positioning sleeve 38 and fastness set 41 respectively.

Figure 8:
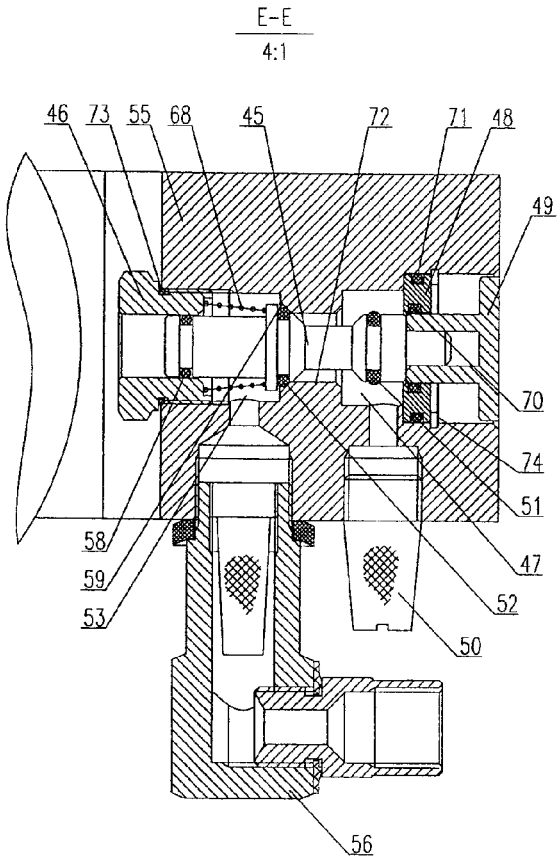
FIG. 8: "E-E" cutaway view of this invention enlarged in reference to FIG. 2
Figure 9:
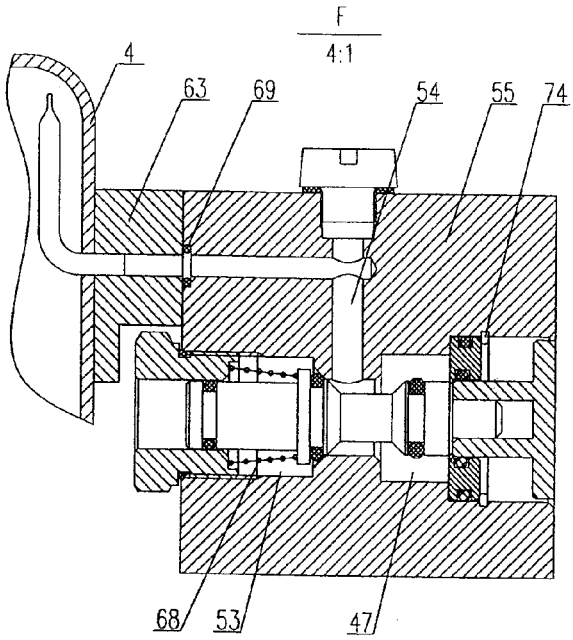
FIG. 9: "F" local diagram enlarged in reference to FIG. 2
Figure 10:
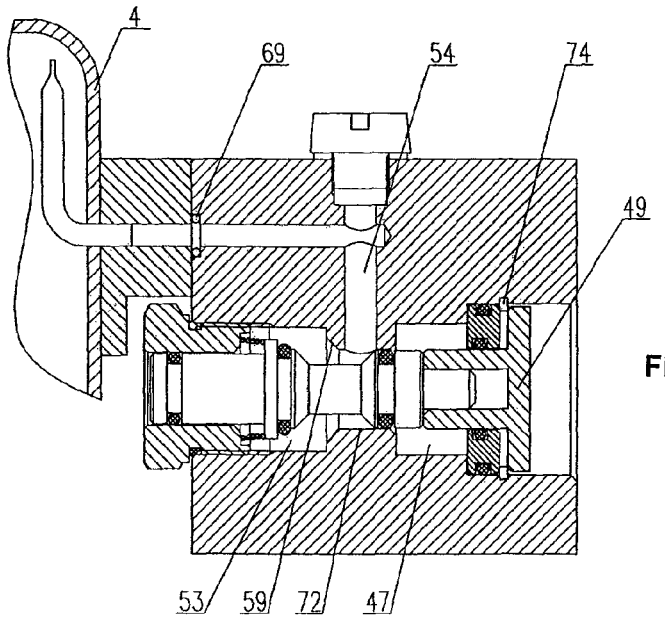
FIG. 10: another working status diagram corresponding to "F" local diagram enlarged in reference to FIG. 9, which specially indicates the position of button and pneumatic valve core when the high-pressure air is delivered to the oil chamber
Figure 11:
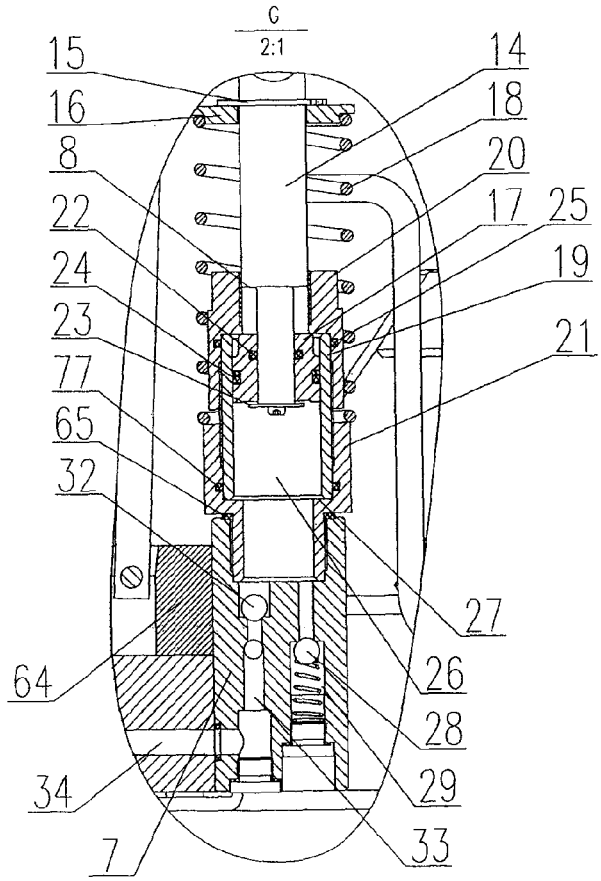
FIG. 11: "G" local diagram enlarged in reference to FIG. 2

According empirical example as indicated in FIGS. 8, 9 and 10, the left side of pneumatic valve bridge 63 is welded to external sleeve 4 with the right side in sealed connection with pneumatic valve block 55 via seal 69; air way 54 on the pneumatic valve block 55 is connected with oil chamber inside the external sleeve 4; whereas, the high-pressure air chamber 53 is connected with air source tie-in assembly 56; pneumatic valve core 45 and relevant parts are provided with seal 51, 52, 58 and 70 used for dynamic sealing as well as seal 71 used as static seal; pneumatic valve block 55 constitute hole and axle seal with column washer 48 for axial positioning; at normal state, the seal 52 on the pneumatic valve core 45 acts on the inner cone sealed face 59 of the pneumatic valve block 55 under the pressure imposed by the compressed spring 68 to realize the combined sealing, and separate the high-pressure air chamber 53 from air way 54. Air way 47 installed on the pneumatic valve block 55 in connection with air way 54 is connected to muffler 50; fastness set 46 of valve core is connected to the pneumatic valve block 55 and seal 73 via screw pair through static sealing, of which, the axial hole forms dynamic sealed moving pair with left end of pneumatic valve core 45 with the right end face used to position the left end of the compressed spring; the middle part of the pneumatic valve block 55 is provided with an inner hole 72 which can form dynamic sealed moving pair with upper seal 51 on the pneumatic valve core; right end section of pneumatic valve core 45 is firmly fixed to button 49; whereas, external circle of left end of button 49 forms dynamic sealed moving pair with integrated seal 70 for penetrating hole of washer 48; the hole groove of pneumatic valve block on the right end of washer 48 is provided with hole axial circlip 74.

Operating procedures of empirical example for this invention are stated as follows: firstly, place the upper top of jack piston rod 1 under the object to be propped up; Under the action of torsion spring 39, the normal position of oil return valve rod 40 can ensure the highest position of oil return valve mandril in structural space; in other words, the steel ball 43 of oil return valve is thoroughly enclosed in the upper valve seat under the action of compressed spring 44. When the pedal rod 10 is pressed by the operator, moving mechanism would drive the step pump core 14 to move to the lower position under the combined action of connecting rod 9, pin 11, 12, and 13; when the pump core step interface 8 move downwards to contact with upper end of small piston ring 17; meanwhile, the pressure imposed on the step pump core 14 would make the small piston ring 17 of pump cylinder move downwards to the lower end of small piston ring 17 to connect with inner face of step hole; when the step pump core 14 and small piston ring of pump cylinder 17 are pressed, the hydraulic oil inside the pump chamber 26 would pressed into the working oil chamber 67 via the steel ball 28 of oil pressing unilateral valve, oil way 29, 30 and 31; the process of combined displacement of this step pump core 14 and small piston ring 17 of pump cylinder aims to supply oil at high flux for the purpose of facilitating the quick lift of piston rod 1 and piston cylinder 2; when the pressure imposed on the pedal rod 10 is released, the step pump core 14 would quickly move upwards for reverse displacement under the rebound force imposed by the compressed spring 18 to contact with the lower end of small piston ring 17 of pump cylinder at circlip 23 for the purpose of drawing the small piston ring 17 back to the highest position in the pump chamber 26. The process of combined displacement of step pump core 14 and small piston ring 17 of pump cylinder moving upwards aims to produce negative pressure inside the pump chamber 26; the hydraulic oil inside the external sleeve 4 would be pressed into the pump chamber 26 under the action of atmosphere via the oil way 34 and 33 to complete the oil absorption at high flux; when the load imposed on the jack reaches the specific value, pressure inside the oil pressing system would prop up the small piston ring 17; when the pedal rod 10 is pressed or released at this point, the relative displacement is only available between the lower external circle of step pump core 14 and inner hole of small piston ring 17, which enables the jack to press and absorb oil in circulation for the purpose of realizing the automatic conversion of hydraulic dual-speed pump through pressing.

In the hydraulic system of this empirical example, when the loaded oil pressure exceeds the pressure regulating value of high-pressure valve assembly 57, the hydraulic oil pressed out from the pump chamber 26 would automatically prop up and open the steel ball of unilateral valve of high-pressure regulating valve assembly 57 to enable the oil return to the oil chamber of external sleeve 4 via the oil way 35, 36, 33 and 34 to realize the automatic overload protection of the system.

Operating procedures of this pneumatic non-load quick lifting structure as indicated by this empirical example are stated as follows: firstly, deliver the high-pressure air to the high-pressure air chamber 53 of pneumatic valve block 55 via the air source tie-in assembly 56, and then press the button 49 to the left side to enable the pneumatic valve block to overcome the resistance imposed by the compressed spring 68 to move to the left side for the purpose of making seal 52 move away from the inner cone face 59 to facilitate the seal 51 to come into the inner hole 72 for dynamic sealing. At this point, air source inside the high-pressure air chamber 52 would be pressed into the upper position of oil inside the external sleeve 4 to maximize the air pressure inside the oil chamber quickly for the purpose of pressing the hydraulic oil into the working oil chamber 67 of oil cylinder via the oil way 34, 33, 32, 26, 28, 29, and 31; when the button 49 is released, the force imposed by the compressed spring 68 would make the pneumatic valve core 45 move to the left side, and the seal 52 would contact with inner cone face 59 for sealing to suspend the further delivery of high-pressure air into the air way 54; meanwhile, the high-pressure air inside the oil chamber of external sleeve 4 would discharge air to the air chamber 47 and muffler 50 to keep balance with atmosphere.

Once the lifting load process of the jack is completed, it is only needed to overcome the force imposed by the torsion spring to turn the lowest point on the column slanting face 66 on the lower end of oil return joy stick 37 to the top junction of valve mandril 42 for the purpose of making steel ball 43 of oil return valve move away from the valve seat by overcoming the pressure imposed by the compressed spring 44 under the pressure imposed by the valve mandril 42; at this point, the high-pressure oil inside the working chamber 67 of oil cylinder would return to the oil chamber inside the external sleeve 4 via the oil way 31, steel ball of oil return valve, oil way 36 and 34 respectively.

The invention claimed is:

1. A type of pneumatic non-load quick hydraulic dual-speed jack, including framework, base, piston rod, oil cylinder, external sleeve, connecting rod, pin, pedal rod, step pump core, pump body, seal and oil return valve, has the following features: valve soleplate is fixed to the base; a lower fastness set on the pump body is sealed and fixed to the valve soleplate; the pump body is sealed and fixed to an upper fastness set and lower fastness set respectively; small piston ring on a pump cylinder is integrated with an inner hole on the pump body and lower external ring of the step pump core to form a movable assembly; the upper end of the lower fastness set and big external ring of upper fastness set aim to position one end of a compressed spring in accommodation with spring seat; a circlip is used to position the other end of the compressed spring; the middle part of step pump core is provided with pump core step interface.

2. According to claim 1, the pneumatic non-load quick hydraulic dual-speed jack has the following features: the lower fastness set is fixed to the valve soleplate with screw pairs, which is provided with sealing pad at an axle of external thread end of lower fastness set to seal a high-pressure oil between the lower fastness set and valve soleplate; pump body is connected to the lower fastness set with screw pairs with a seal ring used as a static seal shaft between them.

3. According to claim 1, the pneumatic non-load quick hydraulic dual-speed jack has the following features: the lower end of step pump core is provided with axle circlip.

4. According to claim 1, the pneumatic non-load quick hydraulic dual-speed jack has the following features: upper fastness set is connected to the pump body with screw pairs with a seal ring used as a static seal between the upper external ring of the pump body and inside inner hole of the upper fastness set.

5. According to claim 1, the pneumatic non-load quick hydraulic dual-speed jack has the following features: a step hole on a pneumatic valve block is provided with washer, button, pneumatic valve core, compressed spring and valve core fastness set on the same axis.

6. The jack as described in claim 5 has the following features: the left side of a pneumatic valve bridge is connected with external sleeve with the seal provided between the right side of the pneumatic valve bridge and the pneumatic valve block; an air way is connected to the oil cylinder inside the external sleeve.

7. The jack as described in claim 5 also has the following features: the step hole of pneumatic valve block is provided with sealed inner cone face and corresponding seal on the same axis.

8. The jack as described in claim 5 also has the following features: each sealing groove on the pneumatic valve core is provided with seal used for dynamic sealing.

9. The jack as described in claim 5 also has the following features: a sealing groove of each washer is provided with seal respectively used for dynamic and static sealing.

10. The jack as described in claim 5 also has the following features: a seal is installed between the valve core fastness set and pneumatic valve block.

* * * * *